United States Patent [19]

Wu

[11] Patent Number: 4,768,979

[45] Date of Patent: Sep. 6, 1988

[54] ELECTRICAL PLUG AND SOCKET HAVING REPLACEABLE OVERCURRENT PROTECTION DEVICE WITH SAFETY LATCH MEANS

[76] Inventor: Jeng-Shyong Wu, No. 133, Tungshing Road, Toufun, Maulii, Taiwan

[21] Appl. No.: 942,502

[22] Filed: Dec. 16, 1986

Related U.S. Application Data

[63] Continuation-in-part of Ser. No. 894,349, Aug. 7, 1986.

[51] Int. Cl.[4] ..... H01R 13/68

[52] U.S. Cl. ..... 439/622; 337/197

[58] Field of Search ..... 339/147 R, 147 P; 337/197, 198, 201, 213; 439/621, 622

[56] References Cited

U.S. PATENT DOCUMENTS

| | | | |
|---|---|---|---|
| 2,257,608 | 9/1941 | Keefe | 337/197 |
| 2,462,934 | 3/1949 | Athey | 339/147 P |
| 3,377,610 | 4/1968 | Busch et al. | 339/147 P |
| 4,388,604 | 6/1983 | Ahroni | 337/197 |
| 4,420,214 | 12/1983 | Wu | 339/147 P |
| 4,480,891 | 11/1984 | Wu | 339/147 P |
| 4,684,914 | 8/1987 | Wu | 337/198 |

FOREIGN PATENT DOCUMENTS

| | | | |
|---|---|---|---|
| 962904 | 6/1950 | France | 337/198 |

*Primary Examiner*—Gil Weidenfeld
*Assistant Examiner*—Gary F. Paumen
*Attorney, Agent, or Firm*—McGlew and Tuttle

[57] ABSTRACT

An electrical plug which has removable inner components and which may have at its rear end a pair of plug slots which are adapted to receive the prongs of a second plug. Fuses and conductors are removable from and insertable into a channel formed within the housing through two different openings in the housing wall. The conductors and their terminals are part of a conductor assembly which includes a resilient lip for a snap fit into the plug housing. The fuses are connected to a securing body which fits tightly in the housing to provide a connection between the conductor terminals, the fuses, and the prongs.

9 Claims, 6 Drawing Sheets

ELECTRICAL PLUG AND SOCKET HAVING REPLACEABLE OVERCURRENT PROTECTION DEVICE WITH SAFETY LATCH MEANS

This is a continuation-in-part of Ser. No. 894,349, filed Aug. 7, 1986.

FIELD AND BACKGROUND OF THE INVENTION

This application relates to an electrical plug construction including a pair of metallic prongs which are projected from a front end while at a rear end there may or may not be a pair of add-on plug slots or sockets which are adpated to receive the prongs of a second plug.

SUMMARY OF THE INVENTION

It is an object of the invention to provide an electrical plug including an insulating housing having a channel, and a pair of conductors extending into the channel having a terminal fixed to the end of the channel. A seat of insulating material is provided in the channel, between the terminals, so as to position and fix the terminals relative to the channel. A pair of prongs extend into the insulating housing. These prongs have at least a portion communicating with the channel. A securing body of insulating material is disposed within the channel and positioned between respective ones of the pair of prongs and the terminals, the securing body being removable from the housing. A pair of fuse elements are preferably disposed in the channel electrically connected between each set of one prong and one terminal, the securing body engaging a portion of each of the fuse elements so as to fix each of the fuse elements in the housing.

A further object of the invention is to provide an electrical plug and socket construction which is simple in design, rugged in construction and economical to manufacture.

Accordingly, it is the object of the invention to provide an improved electrical plug construction.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matters in which a preferred embodiment of the invention are illustrated.

DETAILED DESCRIPTION OF EMBODIMENTS

Figure 1A:
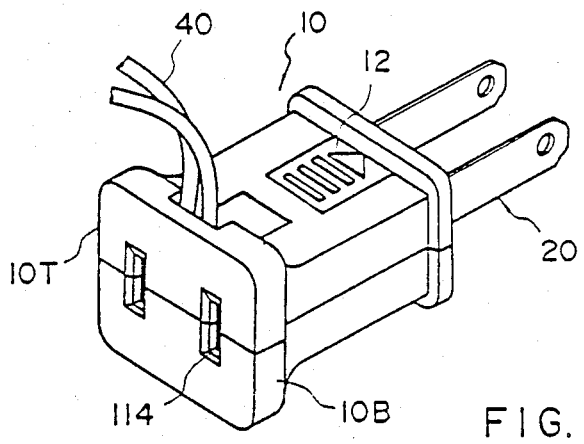
FIG. 1*a* is a perspective view showing an embodiment of an improved electrical plug according to the invention.
Figure 1B:
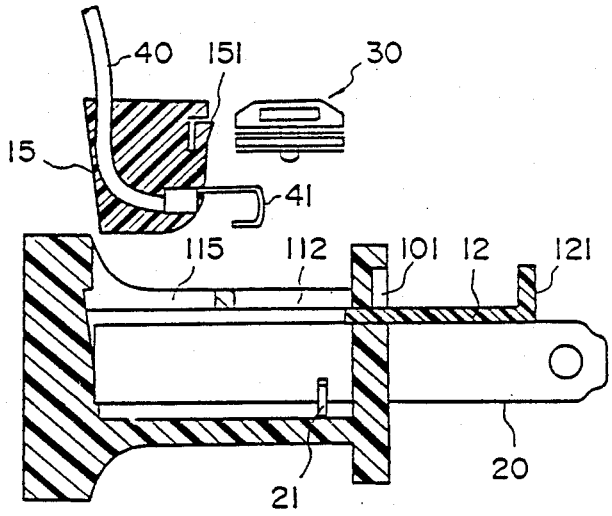
FIG. 1*b* is an exploded view of the electrical plug shown in FIG. 1*a;*
Figure 1C:
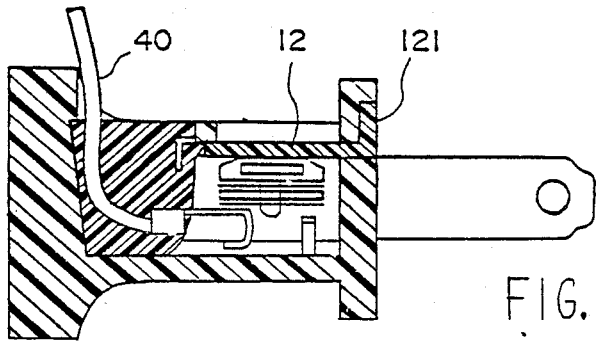
FIG. 1*c* is a sectional view showing the conductor assembly and securing body assembled.
Figure 2A:
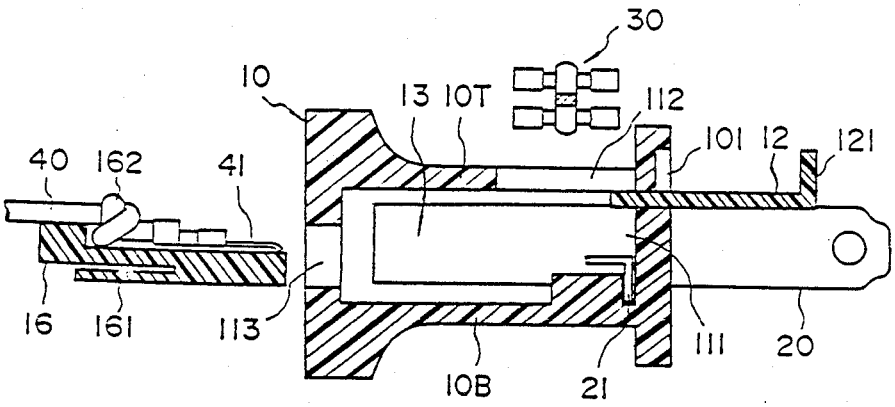
FIG. 2*a* is an exploded view showing a securing body which may be removed from the top side and a conductor assembly which may be removed from the rear portion of the housing.
Figure 2B:
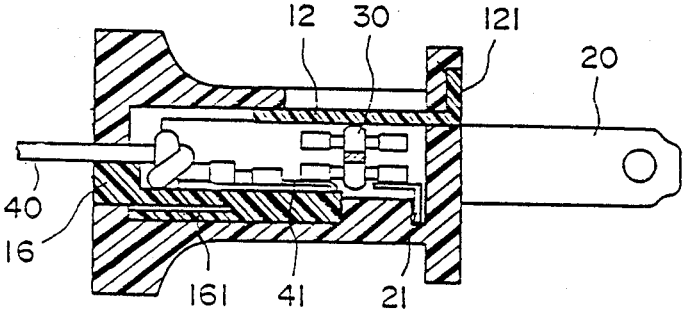
FIG. 2*b* is a sectional view showing the embodiment of FIG. 2*a* in its assembled state.

Referring to FIGS. 1 and 2, the electrical plug of the present invention includes a housing 10 of insulating material split into top and bottom halves 10T and 10B (FIG. 1) having a front opening, a top wall opening 112 and a rear opening 113 (FIG. 2). At the rear end, instead of an opening 113, there may be a pair of socket slots 114 (FIG. 1) serving as receptacles to a second plug. A pair of metallic prongs 20 each has a branch terminal 21. The branch terminal 21 effects mounting within the housing and also connects with fuses on one end of securing body 30. The other end of the securing body is to contact with a terminal 41 of an incoming conductor 40 to constitute a part of the circuit. Through the top wall opening 112, the ready mounted securing body 30, carrying fuse elements, is to be inserted. The inserted securing body positions the fuses so as to be connected between conductor terminal 41 and prong branch 21 as aforementioned. The opening 112 is to be covered with a sliding door 12 with lock flange 121 which is to catch into a recess 101 provided in the corresponding position on the front end wall of the housing 10.

In the embodiment shown in FIG. 1, the conductor 40 is preplanted into a conductor assembly including a block 15 having a resilient lip 151 and is inserted into the housing 10 through an opening 115 in top wall 10T. In the embodiment of FIG. 2 the conductor 40 is ready-mounted on a seat 16 by winding around an anchoring post 162. The seat 16 having a resilient lip 161 is to be inserted into the rear end opening 113.

Figure 5:
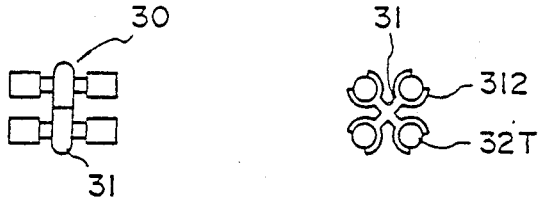
FIG. 5 shows still a further alternative embodiment of a ready-mounted fuse assembly.
Figure 4:
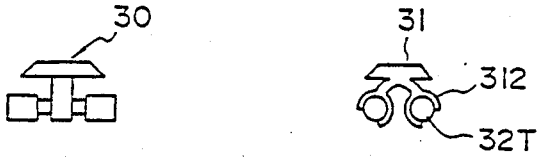
FIG. 4 shows an alternate embodiment of a ready-mounted fuse assembly.
Figure 3:
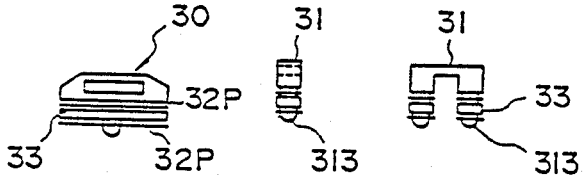
FIG. 3 shows a ready-mounted fuse assembly for use with the embodiment of FIG. 1*b;*

The securing body 30 related herein is further detailed in FIGS. 3, 4 and 5. Generally speaking, the assembly 30, having a seat 31, constitutes either clamps 312 to hold a tubular type fuse cartridge 32T (FIGS. 4 and 5) or a projection 313 to take a plate type fuse strap 32P which is pre-attached onto each of both surfaces of an eyeleted plate 33. Each assembly may take from one to four fuse elements.

Figure 6A:
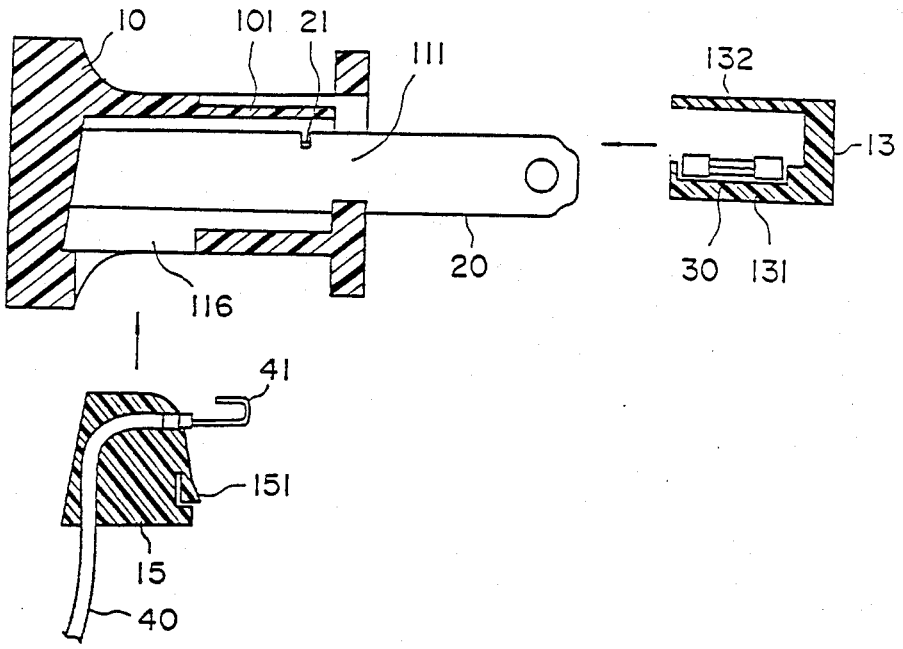
FIG. 6*a* shows an exploded view of an electrical plug assembly wherein the conductor assembly is mounted from the bottom of the plug assembly and the securing body is mounted through the front wall opening.
Figure 6B:
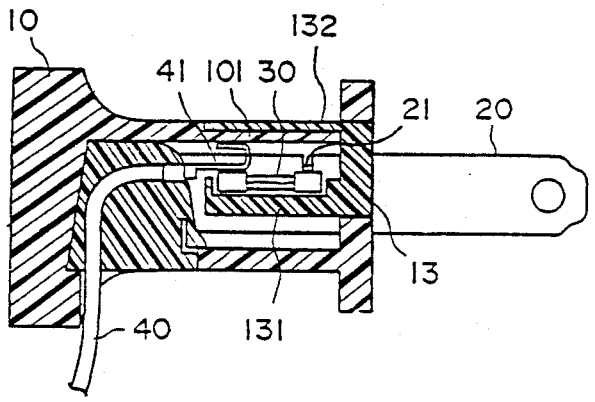
FIG. 6*b* is a sectional view showing the embodiment of FIG. 6*a* in an assembled form.

FIG. 6 shows a typical conversion of the insertion of the securing body 13 from the top side wall opening 112 into that of the front end opening type. The securing body 13, is formed as a semi-enclosed bracket with its bottom member 131 serving as a retainer for the fuse 30, (whatever the type may be) and the top member 132 of the bracket 13, serving as a sliding guide for the bracket 13. The top opening 112 is not employed in this embodiment, therefore, the top opening is sealed by a partition wall 101. In this embodiment, the conductor block 15 is inserted from a bottom side opening 116.

Figure 9:
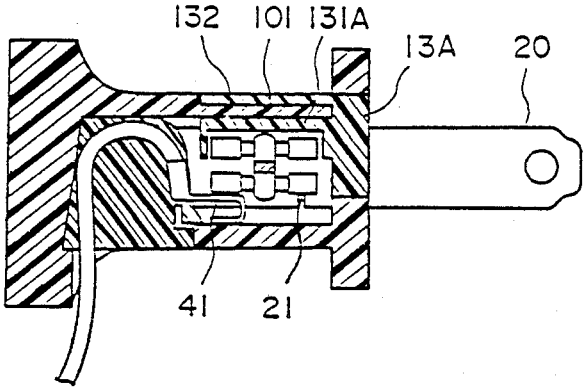
Figure 7:
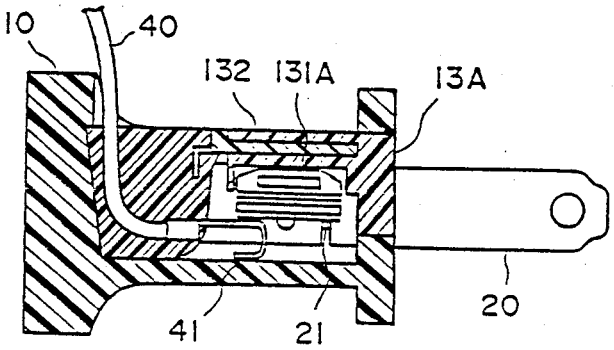
FIG. 7 shows still a further embodiment of the invention in which the securing body is inserted through the front wall opening and the conductor assembly is connected through an opening in the top of the housing.
Figure 8A:
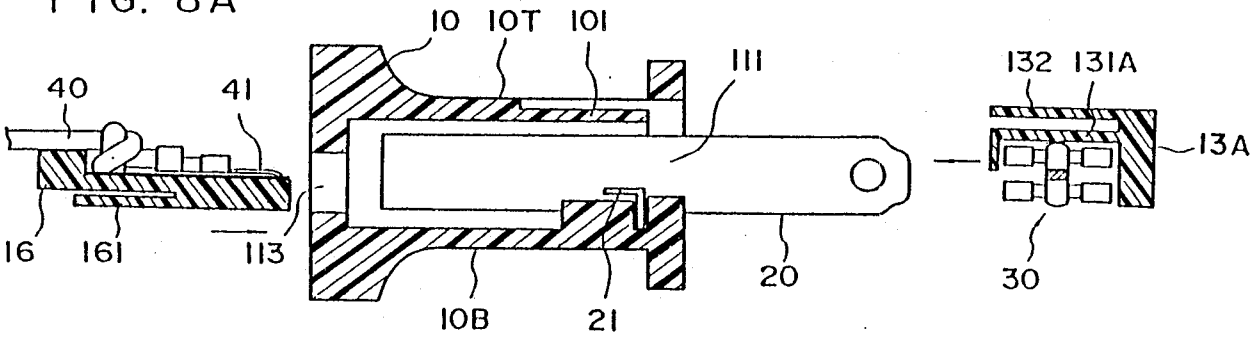
FIG. 8*a* is an exploded view of an electrical plug assembly in which the conductor assembly may be connected through a rear portion of the housing and the securing body may be connected through a front portion of the housing.
Figure 8B:
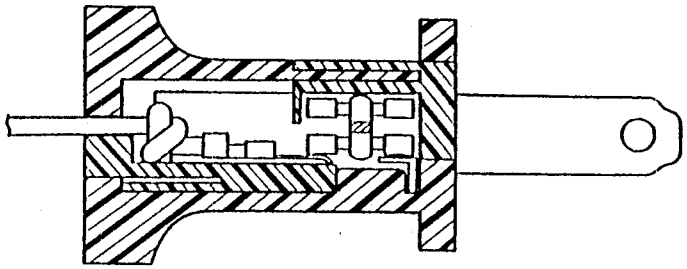
FIG. 8*b* is a sectional view showing the embodiment of FIG. 8*a* in assembled form; and, FIG. 9 is a sectional view showing still a further embodiment of the invention in which the conductor assembly may be admitted through a bottom portion of the housing and the securing body may be admitted through a front portion of the housing.

In the embodiments shown in FIGS. 7, 8 and 9, a different type of insertion bracket 13A is used instead of bracket 13. In the new type of bracket 13A, the original retaining member 131 is moved upward adjacent to the top member 132 to become 131A, and incorporates said top member 132 as a guide along the partition wall 101. As for the conductor block of these three embodiments, FIGS. 7, 8 and 9, each is more or less similar to those in FIGS. 1, 2 and 6.

I claim:

1. An electrical plug comprising: an insulating housing defining a central channel, said housing having at least a first and second opening; first and second contact prongs, each of said contact prongs extending into said insulating housing and, a portion of each of said contact prongs communicating with said channel; a conductor assembly including a conductor body having a resilient lip portion, a first and second conductor mounted to the conductor body, and a first and second conductor terminal, said conductor assembly positionable within one of the openings in said housing, said resilient lip engaging a portion of said housing so as to retain the conductor assembly within said housing, subsequent removal of said conductor assembly not requiring removal of said prongs therewith; and, a securing body insertable within said housing through the other of the openings through said housing, said securing body carrying a pair of fuse elements, the securing body being disposed within said housing so as to position one fuse element in electrical connection with a first prong and the first conductor terminal and to position a second fuse member in electrical connection with the second prong and the second conductor terminal.

2. A plug according to claim 1, wherein said openings are in the front end, the rear end, the top side wall, or the bottom side wall of the housing.

3. A plug according to claim 1, wherein said conductor assembly is admitted into the housing through an opening in the rear end thereof.

4. A plug according to claim 1, wherein said conductor assembly is admitted into the housing from one of a top, or a bottom side wall opening.

5. A plug according to claim 1, wherein the securing body is removable from and insertable into one of a top or bottom side wall opening and said housing includes a locking sliding door covering said side wall opening.

6. A plug according to claim 1, wherein the securing body is removable from and insertable into the front end of the housing.

7. A plug according to either of claims 1 or 6, wherein the securing body is in the form of a semi-enclosed bracket having a retaining member to seat said fuse elements.

8. A plug according to claim 7, wherein the securing body has guide members to slide along a partition wall disposed on a top wall opening of the housing.

9. A plug according to the claim 1, wherein said housing includes a pair of through slots on the rear end thereof opposite to one of the prong ends for receiving prongs from another plug.

* * * * *